US009087652B2

(12) United States Patent
Dahl

(10) Patent No.: US 9,087,652 B2
(45) Date of Patent: Jul. 21, 2015

(54) ELECTRICAL SWITCH AND METHOD FOR MOUNTING A SWITCHING UNIT OF AN ELECTRICAL SWITCH

(75) Inventor: Jörg-Uwe Dahl, Werder (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 207 days.

(21) Appl. No.: 13/817,928

(22) PCT Filed: Jul. 18, 2011

(86) PCT No.: PCT/EP2011/062258

§ 371 (c)(1),
(2), (4) Date: Feb. 20, 2013

(87) PCT Pub. No.: WO2012/025302

PCT Pub. Date: Mar. 1, 2012

(65) Prior Publication Data

US 2013/0140158 A1 Jun. 6, 2013

(30) Foreign Application Priority Data

Aug. 24, 2010 (DE) ..... 10 2010 035 625

(51) Int. Cl.
*H01H 1/20* (2006.01)
*H01H 77/10* (2006.01)
*H01H 11/00* (2006.01)

(52) U.S. Cl.
CPC ..... *H01H 1/20* (2013.01); *H01H 1/205* (2013.01); *H01H 11/00* (2013.01); *H01H 77/102* (2013.01); *Y10T 29/49105* (2015.01)

(58) Field of Classification Search
CPC ..... H01H 1/205; H01H 77/102; H01H 11/00; H01H 1/20
USPC ..... 200/243–244, 336, 400, 248, 275, 17 R; 29/622
See application file for complete search history.

(56) References Cited

U.S. PATENT DOCUMENTS 4,562,419 A 12/1985 Manthe
5,310,971 A 5/1994 Bonfils
(Continued)

FOREIGN PATENT DOCUMENTS

CN 1296276 A 5/2001
CN 1790582 A 6/2006
(Continued)

OTHER PUBLICATIONS

International Search Report PCT/ISA/210 for PCT/EP2011/062258, dated Nov. 3, 2011.
(Continued)

*Primary Examiner* — Edwin A. Leon
(74) *Attorney, Agent, or Firm* — Harness, Dickey & Pierce, P.L.C.

(57) ABSTRACT

An electrical switch including at least one switching unit includes: a contact lever and two parallel plates, between which the contact lever is resiliently retained by way of pins. The contact lever is inserted into an electrically non-conductive housing of the switching unit, wherein at least one of the pins forms a retaining pin, wherein the length of the retaining pin exceeds the distance between the parallel plates and wherein the retaining pin extends through a hole in each of the two plates and is retained by one pin end in a retaining recess in the housing and by the other pin end in an opposite retaining recess in the housing.

15 Claims, 6 Drawing Sheets

(56) References Cited

U.S. PATENT DOCUMENTS

| | | | | |
|---|---|---|---|---|
| 6,403,901 | B1 | 6/2002 | Dedenbach | |
| 6,791,440 | B2 | 9/2004 | Douville | |
| 7,005,594 | B2 * | 2/2006 | Kim | 200/244 |
| 7,145,419 | B2 | 12/2006 | Kim | |
| 7,189,935 | B1 | 3/2007 | Newase | |
| 7,977,592 | B2 * | 7/2011 | Shmukler et al. | 200/244 |
| 2006/0119455 | A1 | 6/2006 | Park | |

FOREIGN PATENT DOCUMENTS

| | | | |
|---|---|---|---|
| CN | 101335158 | A | 12/2008 |
| DE | 69304374 | T2 | 2/1997 |
| DE | 19836754 | A1 | 2/2000 |
| DE | 19933919 | A1 | 1/2001 |
| DE | 102008049442 | A1 | 4/2010 |
| EP | 0542636 | A1 | 5/1993 |
| EP | 1098343 | A1 | 5/2001 |

OTHER PUBLICATIONS

German Search Report for for PCT/EP2011/062258, dated Nov. 3, 2010.

* cited by examiner

ELECTRICAL SWITCH AND METHOD FOR MOUNTING A SWITCHING UNIT OF AN ELECTRICAL SWITCH

PRIORITY STATEMENT

This application is the national phase under 35 U.S.C. §371 of PCT International Application No. PCT/EP2011/062258 which has an International filing date of Jul. 18, 2011, which designated the United States of America and which claims priority to German patent application number DE 10 2010 035625.5 filed Aug. 24, 2010, the entire contents of each of which are hereby incorporated herein by reference.

FIELD

At least one embodiment of the invention generally relates to an electrical switch.

BACKGROUND

An electrical switch is known from the U.S. Pat. No. 7,145,419 B2. This switch is equipped with a switching unit which has a contact lever which is pivotable around a pivot axis and has two electrical switch contacts and also two plates arranged parallel thereto, between which the contact lever is resiliently retained by way of pins. The distance between the two parallel plates corresponds to the distance of the pins. In order to insulate the switching unit electrically, two plastic caps are provided which are fitted onto the two plates from the outside and insulate the switching unit to the outside.

SUMMARY

At least one embodiment of the invention specifies an electrical switch in which the switching units exhibit good electrical insulation properties and are simple to mount.

Advantageous embodiments of the switch according to the invention are set down in subclaims.

Accordingly, provision is made according to an embodiment of the invention that the contact lever with the plates and the pins is inserted into an electrically non-conductive housing of the switching unit, wherein at least one of the pins forms a retaining pin, wherein the length of the retaining pin exceeds the distance between the parallel plates and wherein the retaining pin extends through a hole in each of the two plates and is retained by one pin end in a retaining recess in the housing and by the other pin end in an opposite retaining recess in the housing.

An important advantage of the switch according to an embodiment of the invention can be seen in the fact that in order to provide electrical insulation for the switching unit a non-conductive housing is present, into which an assembly premounted with plates, pins and contact lever can be inserted in a simple manner. The non-conductive housing provided according to an embodiment of the invention thus provides good electrical insulation properties, while—as will be described in more detail further below—simple mounting nevertheless remains ensured. In addition, the non-conductive housing can also be used for torque transmission and/or enable a connection with a latching mechanism of the switch.

A further important advantage of the switch according to an embodiment of the invention is based on the dual use of at least one of the pins by means of which the contact lever is retained between the parallel plates. That is to say, according to an embodiment of the invention one of the pins forms a retaining pin, the length of which exceeds the distance between the parallel plates, in other words extends beyond the plates and thereby enables the assembly premounted with plates, pins and contact lever to be fitted in the non-conductive housing of the switching unit. For mounting purposes, the premounted assembly must therefore simply be fitted into the housing with the retaining pin.

In order to enable simple and fast mounting, it is considered advantageous if the housing is a one-piece housing. This saves joining together individual housing components in order to form a complete housing.

For further fastening of the assembly formed by contact lever, plates and pins it is considered advantageous if a rotor pin extends through the housing of the switching unit, the two plates and the pivotable contact lever, if the rotor pin forms the virtual pivot axis for the pivotable contact lever and if the rotor pin and the retaining pin run parallel to one another and together firmly connect the two plates to the housing of the switching unit. In this advantageous embodiment the assembly formed by contact lever, plates and pins is therefore retained in the housing of the switching unit not only by the retaining pin but also by the rotor pin arranged parallel thereto, which forms a pivot axis for the contact lever and additionally connects the assembly fitted by means of a retaining pin to the housing of the switching unit.

By preference, the housing of the switching unit and thus the switching unit as a whole is rotatable inside the electrical switch around the pivot axis of the contact lever in order to be able to initiate turning on and off of the switching unit of the switch by pivoting the housing of the switching unit; in this case the pivotable contact lever is preferably pivoted together with the housing. In order to achieve predefined contact forces, a swiveling capability of the contact lever relative to the housing of the switching unit is ensured for example by means of springs.

By particular preference, the housing has two opposite side walls. A retaining recess for receiving the one end of the retaining pin is preferably arranged in the one side wall and a retaining recess situated opposite for receiving the other end of the retaining pin is preferably arranged in the opposite side wall.

The rotor pin is preferably retained by two housing-side bearings, one of which is arranged in the one side wall and the other in the opposite side wall.

In addition, it is considered advantageous if the premounted assembly of the switching unit has a single retaining pin and the length of the other pins of the premounted assembly of the switching unit, although greater than the distance between the parallel plates, is however smaller than the distance between the two side walls of the housing of the switching unit. In such an embodiment, the premounted assembly can namely be positioned particularly simply in the housing of the switching unit since only a single retaining pin needs to be positioned in recesses of the housing in order to be able to fit the premounted assembly formed by contact lever, plates and pins in the housing. In this embodiment, the other shorter pins can be optimized exclusively for the function of the assembly as such because they are not used for retaining or anchoring the assembly within the housing of the switching unit.

Provision can also be made that the retaining pin and a pin running parallel thereto together carry two tension springs, one of which is arranged on the side of the one plate facing away from the contact lever and the other is arranged on the side of the other plate facing away from the contact lever. In this embodiment variant, the tension springs are therefore attached on the outside and spatially separated from the contact lever by the plates.

Provision can furthermore be made that two further parallel pins are present which together carry two further tension springs, one of which is arranged on the side of the one plate facing away from the contact lever and the other is arranged on the side of the other plate facing away from the contact lever. In this form of embodiment, the assembly premounted with the contact lever, the plates and the pins therefore additionally has a total of four tension springs which are arranged in pairs, wherein the tension springs are arranged in pairs on different sides of the contact lever and are spatially separated from the contact lever by the plates.

The electrical switch can for example have a plurality of switching units, as are described above, wherein each switching unit has its own electrically non-conductive housing.

On the side of the two side walls of the housing of each switching unit facing away from the interior of the housing one or more coupling elements are preferably arranged in one piece, by which each and any switching unit can be coupled mechanically with other switching units of the switch. This makes it possible to combine switching units with one another in a particularly simple manner such that in the event of one switching unit being swiveled the other switching units of the switch in each case are swiveled along with it.

By preference, the coupling elements on the one side wall of the housing of the switching unit are reversed with respect to the coupling elements on the other side wall of the housing of the switching unit, which means that housings of switching units of identical construction can be put together directly.

The reclosing range of the switch contacts and also the end position of the contacts in the switched-off state of the switching unit are preferably defined by the design of the plates: To this end the plates are for example equipped with corresponding recesses or lugs which influence the pivoting movement of the contact lever relative to the pivot position of the housing.

The electrical switch contact or contacts of the pivotable contact lever of the switching unit preferably interoperate(s) with associated fixed contacts which are permanently attached in the switch.

The electrical switch in question can for example be a double break circuit breaker which has one or more switching units of the type described above.

By preference, the switch has an associated switching unit for each electrical phase to be switched: In the case of a three-phase switch, three phase-specific switching units, as are described above, are therefore preferably present.

An embodiment of the invention furthermore relates to a method for mounting a switching unit of an electrical switch, as has been described above. Provision is made according to an embodiment of the invention that in the method an assembly is premounted by resiliently fastening a contact lever having at least one electrical switch contact between two plates by means of pins and springs, inserting the premounted assembly into an electrically non-conductive housing of a switching unit of the switch, wherein a retaining pin is inserted by one pin end into a retaining recess in the housing and by the other pin end into an opposite retaining recess in the housing, and a rotor pin is pushed from outside through the interior of the housing, the plates and the pivotable contact lever parallel to the retaining pin, by means of which the contact lever is retained pivotably in the housing and by means of which the two plates are positioned in the housing by the rotor pin and the retaining pin.

BRIEF DESCRIPTION OF THE DRAWINGS

The invention will be described in the following with reference to example embodiments; in the drawings, by way of example.

For the sake of clarity, the same reference characters are always used for identical or comparable components in the figures.

DETAILED DESCRIPTION OF THE EXAMPLE EMBODIMENTS

Figure 1:
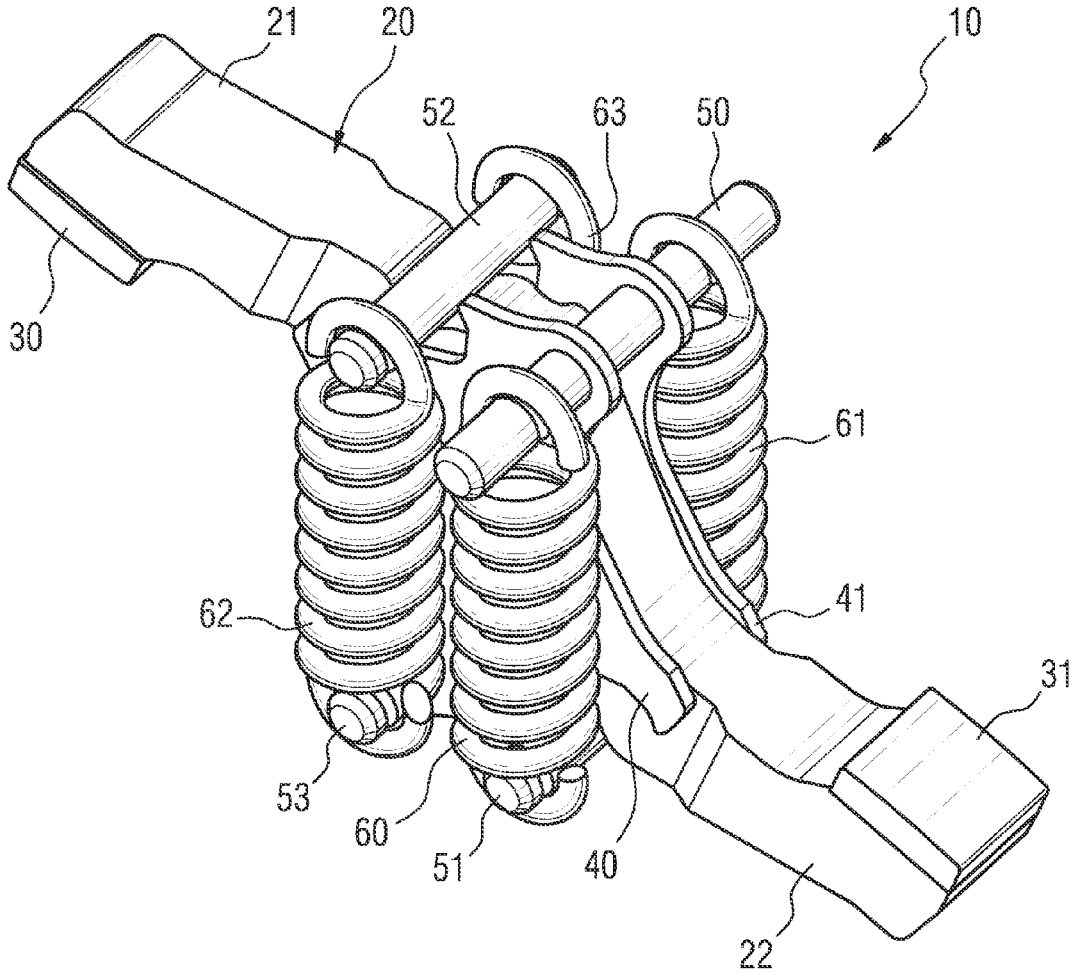
FIG. 1 shows an example embodiment of a premounted assembly formed by a contact lever, two plates, pins and springs, which can be inserted into an electrically non-conductive housing of a switching unit of an electrical switch.

FIG. 1 shows a premounted assembly 10 for a switching unit (not shown in further detail) of an electrical switch. The premounted assembly 10 has a contact lever 20 having a first lever arm 21 and also a second lever arm 22. A first electrical switch contact 30 is located on the first lever arm 21 and a second electrical switch contact 31 is located on the second lever arm 22.

The contact lever 20 is arranged between two plates 40 and 41 which are arranged parallel to one another and have a predefined distance from one another.

FIG. 1 furthermore shows a retaining pin 50 and also a pin 51 running parallel thereto which both together carry two tension springs 60 and 61. The one tension spring 60 is arranged on the side of the one plate 40 facing away from the contact lever 20 and the other tension spring 61 is arranged on the side of the other plate 41 facing away from the contact lever 20. It can be seen that the length of the two pins 50 and 51 is greater than the distance between the two plates 40 and 41 because the two pin ends protrude beyond the plates in order to carry the two tension springs 60 and 61.

FIG. 1 furthermore shows two further pins 52 and 53 running parallel which together carry two further tension springs 62 and 63. The one tension spring 62 is arranged on the side of the one plate 40 facing away from the contact lever 20 and the other tension spring 63 is arranged on the side of the other plate 41 facing away from the contact lever 20. The length of the pins 52 and 53 likewise exceeds the distance between the two plates 40 and 41 in order to enable retention of the two tension springs 62 and 63.

It can also be seen in FIG. 1 that the contact lever 20 is separated from the tension springs 60, 61, 62 and 63 by the two plates 40 and 41 and is immediately or directly surrounded by the two plates 40 and 41 and also the two pins 51 and 52.

Figure 2:
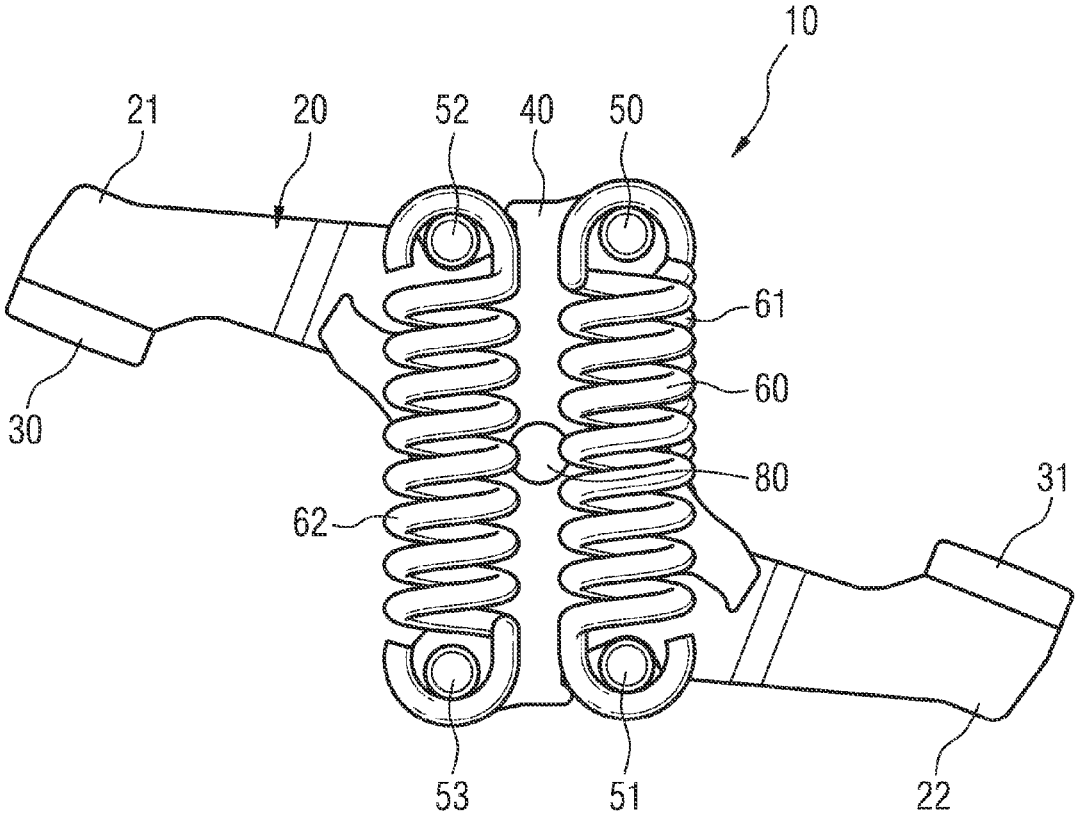
FIG. 2 shows a side view of the premounted assembly in accordance with FIG. 1.

FIG. 2 shows a side view of the premounted assembly 10 in accordance with FIG. 1. The contact lever 20, the pins 50, 51, 52 and 53, the two tension springs 60 and 62 and also the plate 40 can be seen.

It can furthermore be seen that the two plates and also the contact lever 20 each have a flush through-hole 80 which enables a rotor pin not shown in FIG. 2 to be inserted through the assembly 10. In other words, a rotor pin can be passed through or pushed through the two plates 40 and 41 and also through the contact lever 20.

Figure 3:
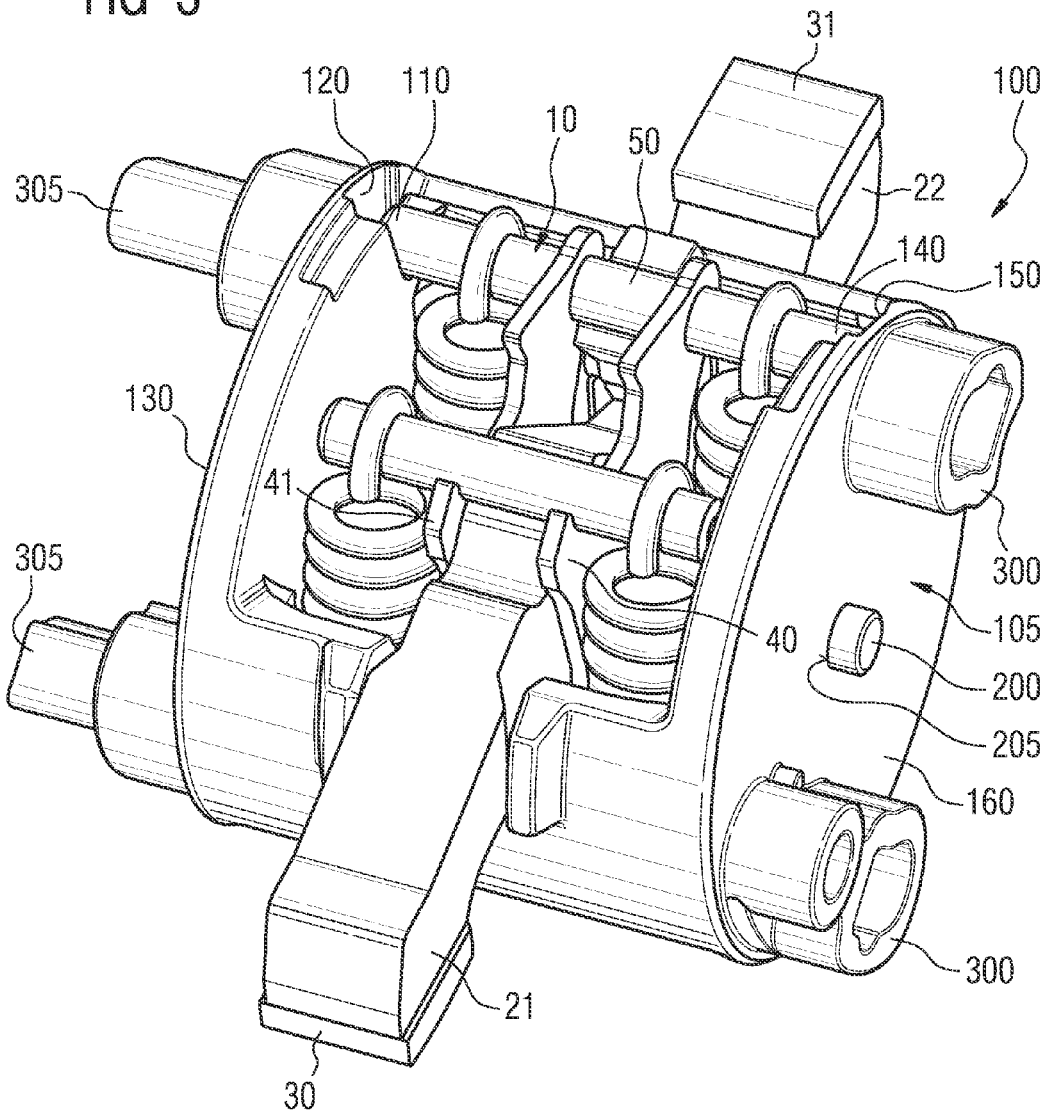
FIG. 3 shows the premounted assembly in accordance with FIGS. 1 and 2 after it has been inserted into an electrically non-conductive housing and anchored by way of a rotor pin.

FIG. 3 shows the premounted assembly 10 in accordance with FIGS. 1 and 2 after it has been inserted into an electrically non-conductive and one-piece housing 105 of a switching unit 100. It can be seen that the length of the retaining pin 50 is dimensioned such that the left-hand pin end 110 in FIG. 3 of the retaining pin 50 can engage in a retaining recess 120 of the left-hand side wall 130 in FIG. 3 of the housing 105. In corresponding fashion, the right-hand pin end 140 in FIG. 3 of the retaining pin 50 can be introduced into a right-hand retaining recess 150 of the right-hand side wall 160 of the housing 105. The premounted assembly 10 thus hangs with the retaining pin 50 in the two retaining recesses 120 and 150 of the housing 105.

In order to achieve secure anchorage of the premounted assembly 10 in the housing 105, the switching unit 100 is furthermore equipped with a rotor pin 200 which is pushed through a through-hole 205 in the side wall 160 into the interior of the housing and passes through the through-holes 80 in the two plates 40 and 41 (cf. FIG. 2) and in the contact lever 20. The rotor pin 200 is retained by a bearing which cannot be seen in FIG. 3 in the left-hand side wall 130 and also by the bearing formed by the hole 205 in the side wall 160 and forms a pivot axis for the pivotable contact lever 20.

In addition, the rotor pin 200 together with the retaining pin 50 arranged parallel thereto forms the fastening for the two plates 40 and 41, which are thereby connected non-rotatably or fixed to the housing 105 of the switching unit 100. The rotor pin also forms the axis of rotation of the switching unit 100 (rotor) in the associated yoke housing.

As a result of the mounting illustrated in FIG. 3 of the premounted assembly 10 in the housing 105 it is possible to swivel the contact lever 20 against the force of the tension springs with respect to the plates 40 and 41, wherein the plates 40 and 41 remain fixed to the housing 105 so that they do not rotate.

The switching unit 100 illustrated in FIG. 3 can be incorporated into an electrical switch, which is not shown, in order to interact with non-movable switch contacts and to switch an electrical current.

FIG. 3 furthermore shows coupling elements 300 and 305 which are formed in one piece on the sides of the two side walls 130 and 160 facing away from the interior of the housing. The coupling elements 300 and 305 allow the switching unit shown in FIG. 3 to be mechanically coupled to prevent its rotation to the left and right with further switching units of identical construction, which means that in the event of an externally forced rotation of one of the switching units the other switching units are accordingly rotated along with it.

To summarize: the switching unit 100 illustrated in FIG. 3 can therefore also be mounted by firstly producing the premounted assembly 10 illustrated in FIGS. 1 and 2. To this end, the contact lever 20 between the two plates 40 and 41 is premounted with the retaining pin 50, the further pins 51, 52 and 53 and also the four springs 60, 61, 62 and 63 (cf. FIGS. 1 and 2). The premounted assembly 10 is subsequently fitted into the housing 105 of the switching unit 100 by fitting the pin ends 110 and 140 into the two retaining recesses 120 and 150 in the two side walls 130 and 160.

After the premounted assembly 10 has been fitted, the rotor pin 200 can be pushed in through the hole 205 in the side wall 160 into the interior of the housing and through the through-holes 80 in the premounted assembly 10 until the rotor pin 200 reaches the corresponding counter bearing on the side wall 130 of the housing 105 and is retained therein. The rotor pin 200 forms the swivel bearing for the contact lever arm 20 and also together with the retaining pin 50 forms the anchorage for the plates 40 and 41 of the assembly 10.

Figure 4:
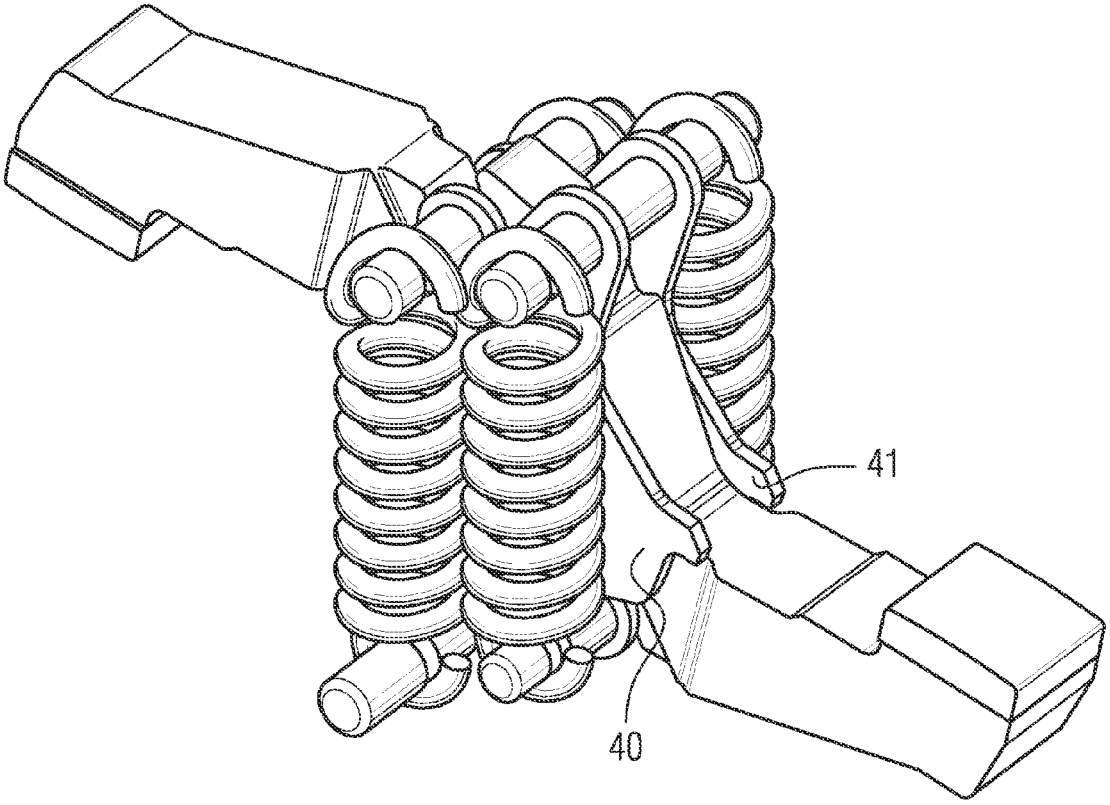
FIGS. 4-6 show a further example embodiment of a switching unit of an electrical switch, in which the plates are configured differently than in the example embodiment in accordance with FIGS. 1 to 3.
Figure 5:
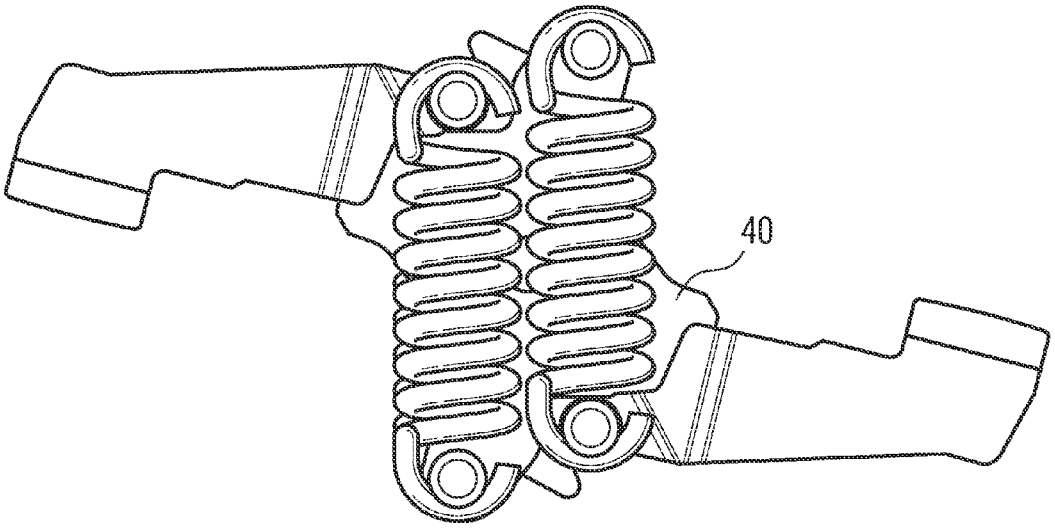
Figure 6:
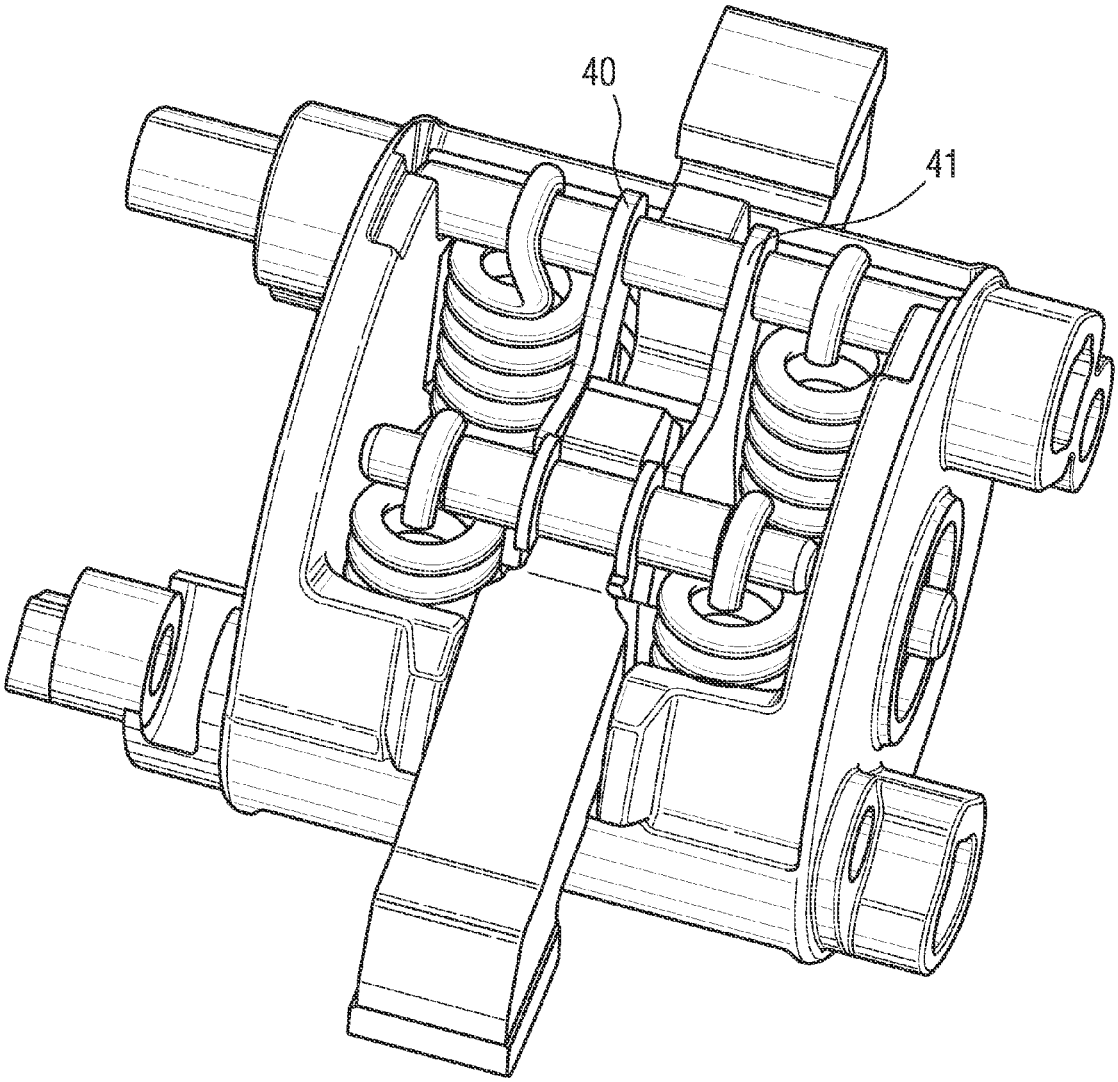

FIGS. 4, 5 and 6 show a further example embodiment of a switching unit of an electrical switch. In this further example embodiment the design of the two plates 40 and 41 is chosen differently, which means that the resulting switching unit establishes a different reclosing range for the contact lever and also, when the switching unit is in the switched-off state, a different end position for the contacts. The remaining features and also the mounting of the assembly correspond to the example embodiment in accordance with FIGS. 1 to 3.

LIST OF REFERENCE CHARACTERS

10 Assembly
20 Contact lever
21 Lever arm
22 Lever arm
30 Switch contact
31 Switch contact
40 Plate
41 Plate
50 Retaining pin
51 Pin
52 Pin
53 Pin
60 Tension spring
61 Tension spring
62 Tension spring
63 Tension spring
80 Through-hole
100 Switching unit
105 Housing
110 Pin end
120 Retaining recess
130 Side wall
140 Pin end
150 Retaining recess
160 Side wall
200 Rotor pin
205 Through-hole
300 Coupling element
305 Coupling element

The invention claimed is:

1. An electrical switch including at least one switching unit, the electrical switch comprising:

a contact lever, pivotable around a pivot axis and including at least one electrical switch contact; and two parallel plates, between which the contact lever is resiliently retained by way of pins, the contact lever with the plates and the pins being inserted into an electrically non-conductive housing of the at least one switching unit, wherein at least one of the pins is a retaining pin, and a length of the retaining pin exceeds a distance between the parallel plates such that the retaining pin extends through a hole in each of the two parallel plates and engages a first retaining recess in the housing with one pin end and engages a second retaining recess in the housing with the other pin end, the first retaining recess being opposite to the second retaining recess.

2. The electrical switch of claim 1, wherein the housing is a one-piece housing.

3. The electrical switch of claim 1, wherein a rotor pin extends through the housing, the two parallel plates and the pivotable contact lever, the rotor pin forms a pivot axis for the pivotable contact lever, and the rotor pin and the retaining pin run parallel to one another and together firmly position the two parallel plates in the housing.

4. The electrical switch of claim 1, wherein the housing is rotatable around the pivot axis, and the pivotable contact lever is swivelable relative to the housing.

5. The electrical switch of claim 1, wherein the housing includes two opposite side walls;

the first retaining recess in the housing is arranged in the one side wall and the second retaining recess in the housing is arranged in the opposite side wall, and the rotor pin is retained by two housing-side bearings, one of the bearings being arranged in the one side wall and the other of the bearings being arranged in the opposite side wall.

6. The electrical switch of claim 1, wherein the at least one switching unit includes a single retaining pin and wherein a length of the other pins of the switching unit is greater than the distance between the parallel plates and is smaller than the distance between the two side walls of the housing.

7. The electrical switch of claim 1, wherein the retaining pin and a pin running parallel to the retaining pin each carry two tension springs, one of the tension springs being arranged on the side of the one plate facing away from the contact lever and the other of the tension springs being arranged on the side of the other plate facing away from the contact lever.

8. The electrical switch of claim 1, wherein the at least one switching unit includes at least two switching units and wherein on the side of the two side walls of the housing of each switching unit, facing away from the interior of the housing, one or more coupling elements are arranged in one piece, by which the at least two switching units are coupled mechanically with adjacent switching units of the switch.

9. The electrical switch of claim 1, wherein the design of the plates defines the reclosing range of the contact lever and also, in the switched-off state of the switching unit, the end position of the switch contacts.

10. A method for mounting a switching unit of an electrical switch, the method comprising:

resiliently fastening a contact lever, including at least one electrical switch contact, between two plates by way of pins and springs, to premount an assembly;

inserting the premounted assembly into an electrically non-conductive housing of the switching unit, wherein the inserting includes inserting a retaining pin by one pin end into a first retaining recess in the housing and by the other pin end into a second retaining recess in the housing such that the one pin end engages with the first retaining recess and the other pin end engages with the second retaining recess, the first retaining recess being opposite to the second retaining recess; and pushing a rotor pin from outside through an interior of the housing, the plates and the pivotable contact lever parallel to the retaining pin, by which the contact lever is retained pivotably in the housing, the two plates being positioned in the housing by the rotor pin and the retaining pin.

11. The electrical switch of claim 2, wherein a rotor pin extends through the housing, the two parallel plates and the pivotable contact lever, the rotor pin forms a pivot axis for the pivotable contact lever, and the rotor pin and the retaining pin run parallel to one another and together firmly position the two parallel plates in the housing.

12. The electrical switch of claim 2, wherein the housing is rotatable around the pivot axis, and the pivotable contact lever is swivelable relative to the housing.

13. The electrical switch of claim 2, wherein the housing includes two opposite side walls, the first retaining recess in the housing is arranged in the one side wall and the second retaining recess in the housing is arranged in the opposite side wall, and the rotor pin is retained by two housing-side bearings, one of the bearings being arranged in the one side wall and the other of the bearings being arranged in the opposite side wall.

14. The electrical switch of claim 1, wherein the first retaining recess and the second retaining recess are in outer edge portions of the housing.

15. The electrical switch of claim 1, wherein the retaining pin and a pin running parallel to the retaining pin each carry two tension springs, each of the two tension springs being located between a respective one of the two parallel plates and a respective side wall of the housing.

* * * * *